US005720852A

United States Patent [19]

Virta et al.

[11] Patent Number: 5,720,852

[45] Date of Patent: Feb. 24, 1998

[54] METHOD AND DEVICE FOR STABILIZING THE RUNNING OF A PAPER WEB IN CONNECTION WITH A PAPER GUIDE ROLL

[75] Inventors: Raimo Virta; Vesa Vuorinen, both of Turku, Finland

[73] Assignee: Valmet Paper Machinery Inc., Helsinki, Finland

[21] Appl. No.: 450,334

[22] Filed: May 25, 1995

[30] Foreign Application Priority Data

May 31, 1994 [FI] Finland ..... 942541

[51] Int. Cl.[6] ..... D21F 1/42

[52] U.S. Cl. ..... 162/193; 162/202; 162/289; 162/306; 162/358.1; 162/361

[58] Field of Search ..... 162/306, 307, 162/193, 205, 207, 202, 281, 289, 297, 358.1, 361; 34/640, 642

[56] References Cited

U.S. PATENT DOCUMENTS

| | | | |
|---|---|---|---|
| 3,526,574 | 9/1970 | Beachler et al. | 162/358.1 |
| 4,566,946 | 1/1986 | Koponen et al. | 162/359 |
| 4,684,443 | 8/1987 | Kerttula et al. | 162/255 |
| 4,943,351 | 7/1990 | Wedel | 162/307 |
| 5,232,555 | 8/1993 | Daunais et al. | 162/307 |

FOREIGN PATENT DOCUMENTS

| | | |
|---|---|---|
| 0364114 | 4/1990 | European Pat. Off. . |
| 64823 | 9/1983 | Finland . |
| 69144 | 8/1985 | Finland . |
| 78943 | 2/1989 | Finland . |
| 93035 | 3/1990 | Finland . |
| 935953 | 12/1993 | Finland . |
| 4303315 | 6/1993 | Germany . |
| 9101407 | 2/1991 | WIPO . |

*Primary Examiner*—Peter Chin

[57] ABSTRACT

A method and device for stabilizing the running of a paper web in a paper machine in connection with a paper guide roll, in particular between a press section and a dryer section. In the method, the paper web is passed over the paper guide roll onto a drying wire or equivalent and negative pressure (suction) in the opening nip of the paper guide roll is lowered until a transition is made to the side of positive pressure in order to press the paper web against the drying wire or equivalent. The device includes a nozzle beam and an air chamber which communicates with a blow air duct. The nozzle beam is placed at the side of the opening nip of the paper guide roll such that the blowing discharged out of a nozzle opening of the nozzle beam is directed at the opening nip in order to press the paper web against the drying wire or equivalent.

19 Claims, 3 Drawing Sheets

METHOD AND DEVICE FOR STABILIZING THE RUNNING OF A PAPER WEB IN CONNECTION WITH A PAPER GUIDE ROLL

BACKGROUND OF THE INVENTION

The present invention relates to a method for stabilizing the running of a paper web in a paper machine in connection with a paper guide roll, in particular between a press section and a dryer section of a paper machine. In the method, the paper web is passed by means of the paper guide roll onto a drying wire or equivalent felt.

The present invention also relates to a device in a paper machine for stabilizing the running of a paper web in connection with a paper guide roll, in particular between the press section and the dryer section of a paper machine. The device comprises a nozzle beam, an air chamber, and communicates with a blow-air duct for entry of air into the air chamber.

Typically, between a press section and a dryer section, paper guide rolls are used. It is a drawback of prior art paper guide rolls that the movement of rotation thereof induces an air flow around the paper guide roll, which air flow produces a pressure in a closing nip space at the inlet side between the paper web and the paper guide roll. This pressure attempts to separate the paper web from the paper guide roll as it is between the web and the roll, and the air bag thus formed produces instability in the running of the web and wrinkles and may even result in web breaks. A critical juncture in the manufacture of paper is the transfer by means of a paper guide roll from the press section to the dryer section, because at this stage, owing to the high moisture content, the strength of the web is at its lowest.

These problems are experienced with particular emphasis in high-speed paper machines whose running speed is higher than about 1000 meters per minute. Another problem prevalent in connection with a paper guide roll is that the opening nip defined between the web and the paper guide roll produces a vacuum, as a result of which the moist web, which tends to be stretched, momentarily starts following the roll face of the paper guide roll. Consequently, the edge of the web stretches, which is seen as separation of the web from the drying wire in the free wire gap. Attempts have been made to eliminate this problem by increasing the pressing of the paper guide roll against the wire vis-a-vis an increase in the suction capacities of the blow boxes and an increase in the draw difference of the web. However, an increased pressing of the paper guide roll produces an air bag between the web and the roll face before the press point. Nor is it always possible to increase the suction capacity of the blow boxes, because the wire is deflected into contact with the box face, in which case an increased draw difference deteriorates the properties of the paper. If pressing of the wire against the paper guide roll is not employed, the web is smooth on the roll face, but the control of the edges of the web requires a high vacuum in the blow boxes, in which case the wire tends to be deflected excessively. Also, the operation is sensitive to the wire permeability and to changes in the web.

With respect to the prior art, reference is made to the assignee's Finnish Patent Application No. 935953 which describes a device arranged in connection with a paper guide roll and by means of which it is possible to reduce the flows of air that interfere with the support contact between the cylinder mantle of the paper guide roll and the paper web and bag formations in the paper web and corresponding drawbacks arising from the flows of air. This device comprises a box beam arranged at the side opposite to the inlet and contact sector of the paper web. The box beam is coupled permanently with the bearing supports of the paper guide roll or with parts connected with the bearing supports. The device includes closing parts arranged in connection with the box beam and at the distance of a small gap from the mantle of the paper guide roll. The closing parts define a closed space in the interior of the box beam and between them, from which closed space an air discharge duct or ducts passes/pass to outside the box beam. This prior art device is attached to the mechanisms for moving the roll, and it is used in situations in which the flow velocities are rather low.

OBJECTS AND SUMMARY OF THE INVENTION

An object of the present invention to provide novel solutions for the problems discussed above.

In view of achieving the object stated above and others, in the method in accordance with the invention, negative pressure (suction) in the opening nip of the paper guide roll is lowered, i.e., the absolute value of the pressure is raised, and a transition is made to the side of positive pressure so as to press the paper web against the drying wire or equivalent felt. Pressing of the web, and the transition from a negative pressure to a positive pressure, can be achieved by directing air blowings into the opening nip along a face of the paper guide roll in a direction opposite to the direction of rotation thereof.

The device in accordance with the invention includes a nozzle beam placed at the side of the opening nip of the paper guide roll such that the blowing discharged out of the nozzle opening of the nozzle beam of the device is directed at the opening nip in order to press the paper web against the drying wire or equivalent.

By means of the method and device in accordance with the invention, the pressure status in the opening nip of the paper guide roll is changed so that, depending on the extent of blowing, the negative pressure is reduced and/or a transition is made to the side of positive pressure. This takes place by means of the device in accordance with the invention which blows the air along the roll face in the direction opposite to the direction or rotation right into the nip. Depending on the extent of blowing, the negative pressure in the pressure status of the nip is reduced and a transition is made to the side of positive pressure, in which case a thin air layer is formed below the web, and the web is pressed against the wire face. When the blowing is in operation, the pressing of the paper guide roll can be reduced to a sufficiently great extent so that the detrimental air bag at the forward side of the roll is eliminated. In this manner, the detrimental air bag can be eliminated and the adhering of the web to the wire is improved.

In accordance with the invention, the device is placed at the web side, which also results in the advantage that the arrangement is no longer so sensitive to wire contamination, because the blowing is not passed through the wire. The preferred embodiment of the invention is placed in a paper machine at the point at which the web is transferred by the intermediate of the paper guide roll from the press section to the dryer section. In principle, the invention can also be employed at other locations in a paper machine at which the web has a tendency, in an opening nip, to follow the smooth roll face, such as, for example, in the dryer section.

Further, according to the invention, if necessary, the device operates for the entire time during running of the web, and in its operation, no members in contact with the roll face are used as an aid, such as doctors, and the device is out of contact with the roll. The nozzle is arranged to move along with the paper guide roll.

In accordance with the invention, blowing is carried out by means of the blow nozzle so that the pressure status in the opening nip is changed. As a result, the pressing on the roll can be reduced whereby a thin air flow is produced between the roll and the web, and no detrimental air bag is formed. This also permits a lower requirement of vacuum in the upper blow boxes, whereby the deflection of the wire is also reduced.

The arrangement is also favorable in the respect that it is not sensitive to the permeability of the wire.

According to an exemplifying embodiment of the invention, the device extends substantially across the entire width of the web, and it is a unified slot nozzle, through which air is blown. In a second exemplifying embodiment of the invention, the device is placed at each edge of the web in which case no air blowing is applied to the middle area of the web through the slot nozzle. In other preferred embodiments, the device has been constructed so that the blow width and the blow velocity in the lateral areas can be regulated. The arrangement in accordance with the invention is primarily intended for high-speed paper machines but, if the web is of inferior quality, the same advantages are also obtained with paper machines of lower running speeds.

In the following, the invention will be described in more detail with reference to the figures in the accompanying drawing. However, the invention is not strictly confined to the details of these illustrated embodiments alone.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
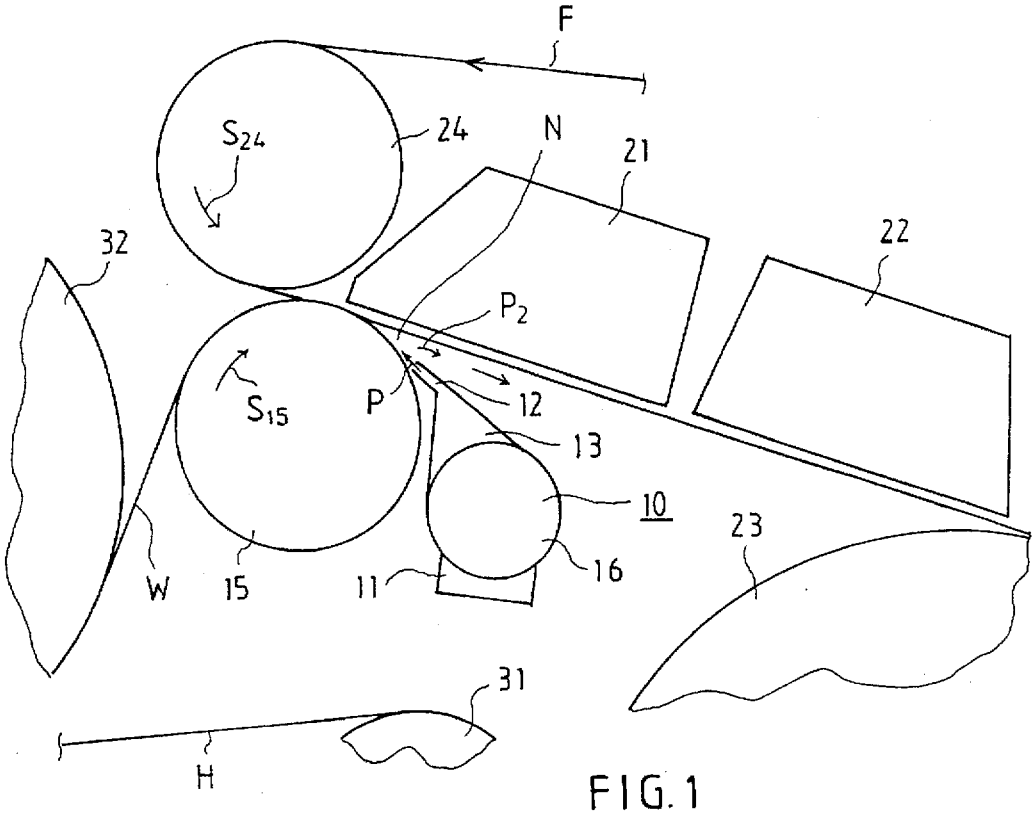
FIG. 1 is an illustration of an embodiment of the device in accordance with the invention in the running position and used in the method in accordance with the invention.

Referring to the drawings wherein like reference numerals refer to the same or similar elements, as shown in FIG. 1, a paper web W arrives along with a press felt H and is transferred from an upper press roll 32 as a short free draw by means of a paper guide roll 15 onto a lower face of a drying wire F. The drying wire F is guided by a reversing roll 24 placed above the paper guide roll 15 into contact with the web W. After the roll 24, the drying wire F has a straight run onto a first drying cylinder 23 or equivalent. On the straight run of the drying wire F between the guide roll 24 and the cylinder 23, and inside the loop of wire F, blow-suction boxes 21,22 are arranged and produce a field of negative pressure on the run of the drying wire F. This field of negative pressure makes the web W adhere reliably to the lower face of the drying wire F. As it is guided by the alignment roll 31, the press felt H is turned back toward the press section. In connection with the paper guide roll 15, at its trailing side or back side in the running direction of the web W, i.e., at the side of the opening nip N of the paper guide roll 15 and at the side of the paper web W, a blow device 10 is placed in accordance with the invention.

Figure 2:
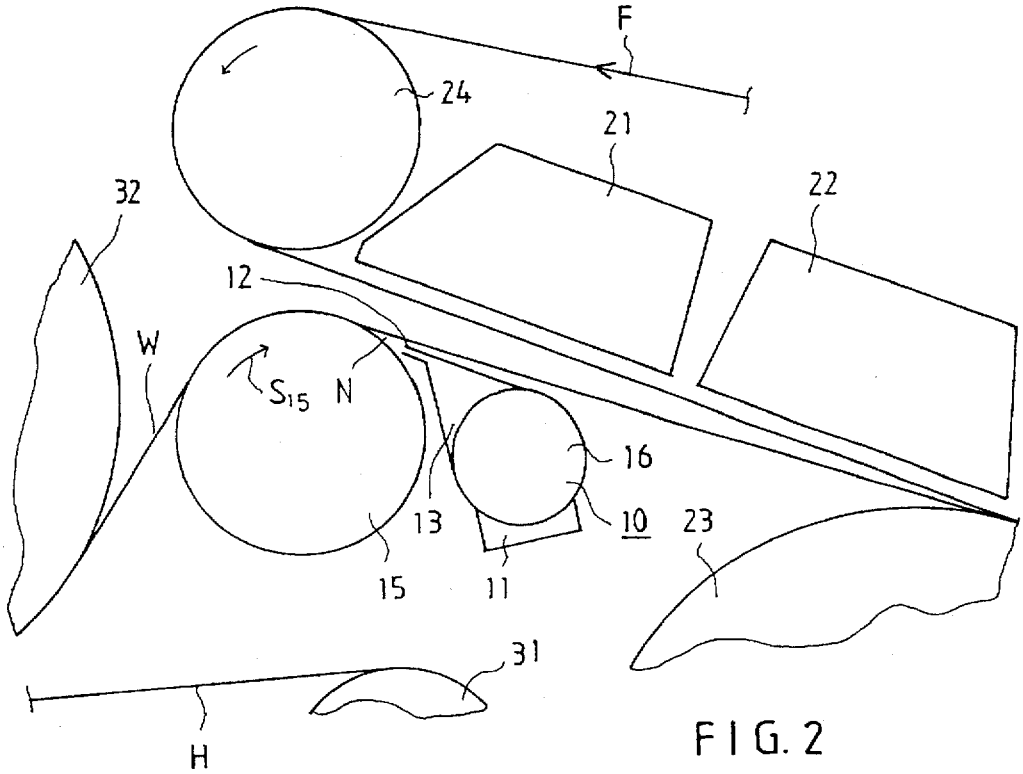
FIG. 2 is the device shown in FIG. 1 with the paper guide roll placed in the tail threading position.

In FIG. 1, the device 10 is shown in the running position, i.e., in the normal state of operation of the paper machine, and in FIG. 2 the device is shown in the threading position in which a narrow leader strip is passed first through the press section and then through the dryer section. The device 10 comprises a nozzle beam 13 having a nozzle opening 12 through which a directed air jet is blown. An air intake or inlet duct 11 provides a flow of air into the nozzle beam 13. The nozzle beam 13 of the device 10 is box-like and shaped so that its nozzle opening 12 directs the air directly into the opening nip N of the paper guide roll 15, i.e., the nozzle beam 13 extends into the opening nip. The nozzle beam 13 communicates with a blow-air chamber 16 which further communicates with the air inlet duct 11, and the nozzle opening 12 is preferably a slot nozzle. The device is attached to the mobile frame constructions (not shown) of the paper guide roll 15 displaceably by means of arrangements that are known in themselves to a person skilled in the art.

Out of the nozzle opening 12 of the device 10, an air flow P is blown into the opening nip N of the paper guide roll 15, whereby the negative pressure in the nip N is reduced and a transition is made to the side of positive pressure. The device 10 blows air from the nozzle opening 12 substantially along the face of the paper guide roll 15 in the direction opposite to the direction of rotation $S_{15}$ thereof. The distance of blowing on the roll face is from about 50 mm to about 400 mm, preferably from about 100 mm to about 300 mm. The blowing P changes the pressure status in the nip N, and the adherence of the web W to the lower face of the drying wire F is secured. The pressure that is employed in the blow device is from about 500 Pa to about 5000 Pa, and the blow velocity is from about 10 meters per second to about 70 meters per second. The width of the nozzle slot is between about 1 mm and about 5 mm, preferably about 2 mm. The blowing P enhances the adhering of the web to the drying wire F. For this reason, on the paper guide roll 15, it is possible to employ reduced pressing whereby the air bag is eliminated as a thin layer of air between the web W and the roll 15 in the running direction of the web W. From the nip N, part of the blowings P turn and follow the paper web, as is indicated by the arrows $P_2$.

In the prior art constructions, the pressures in the upper blow boxes 21,22 have been about 2000 Pa in order to produce a negative pressure of about 200 Pa on the wire F run opposite to the boxes 21,22. When the blow device 10 is used in accordance with the invention, a lower pressure can be employed in the upper blow boxes 21,22.

In the threading position shown in FIG. 2, the paper guide roll 15 has been shifted downwards in a manner in itself known, and so has the device 10, which is attached to the frame constructions (not shown) of the paper guide roll, been downwardly shifted. The device 10 can also be employed during the tail threading for blowings aiding the threading but, if desired, it can also be closed for the time of the tail threading. The device 10 is pivoted along with the paper guide roll 15.

Figure 3:
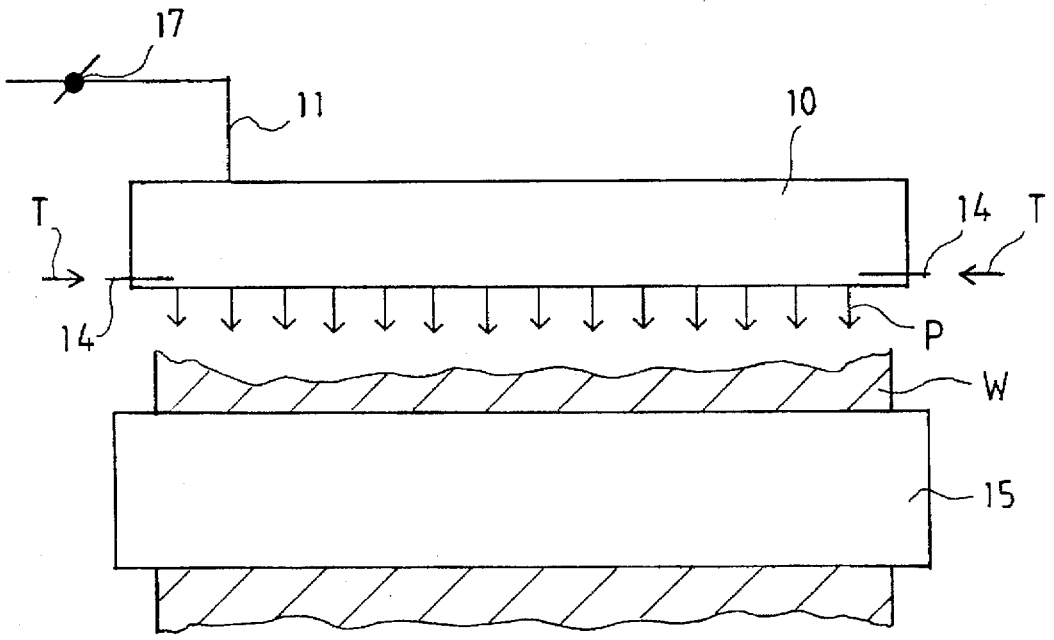
FIG. 3 is an illustration of an exemplifying embodiment of the invention seen in the direction of width of the web as an embodiment in which the blow width has been made narrower.
Figure 4:
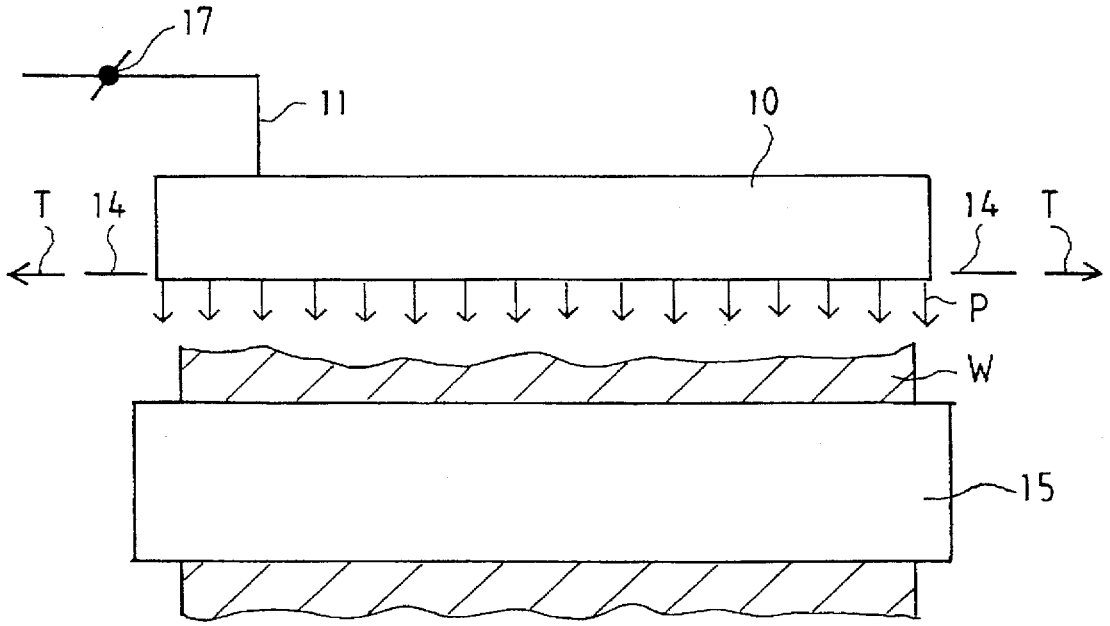
FIG. 4 is an illustration of the embodiment of the invention shown in FIG. 3 wherein the blowing is carried out across the entire width of the web.

As shown in FIGS. 3 and 4, in this exemplifying embodiment of the device 10, the device extends substantially across the entire width of the paper web W and forms a unified blow area P through the slot nozzle. The width and the velocity of the blowing P applied to the lateral areas of the paper web W can be regulated by means of lateral boards 14 which affect the size of the nozzle opening 12. As shown in FIG. 3, the blowing P in the lateral area has been closed by means of the lateral boards, and as shown in FIG. 4 the lateral boards 14 have been shifted so that the blowings P also extend to the lateral areas of the web W. The direction of shifting of the lateral boards 14 is indicated by arrows T. The blow air is passed into the device 10 along the air intake duct 11, the flow rate in duct 11 being regulated and controlled by means of a control member 17. By means of the lateral boards 14, the blowing P is closed in the lateral areas of the web W over a width of from about 0 mm to about 500 mm, preferably from about 0 mm to about 150 mm.

Figure 5:
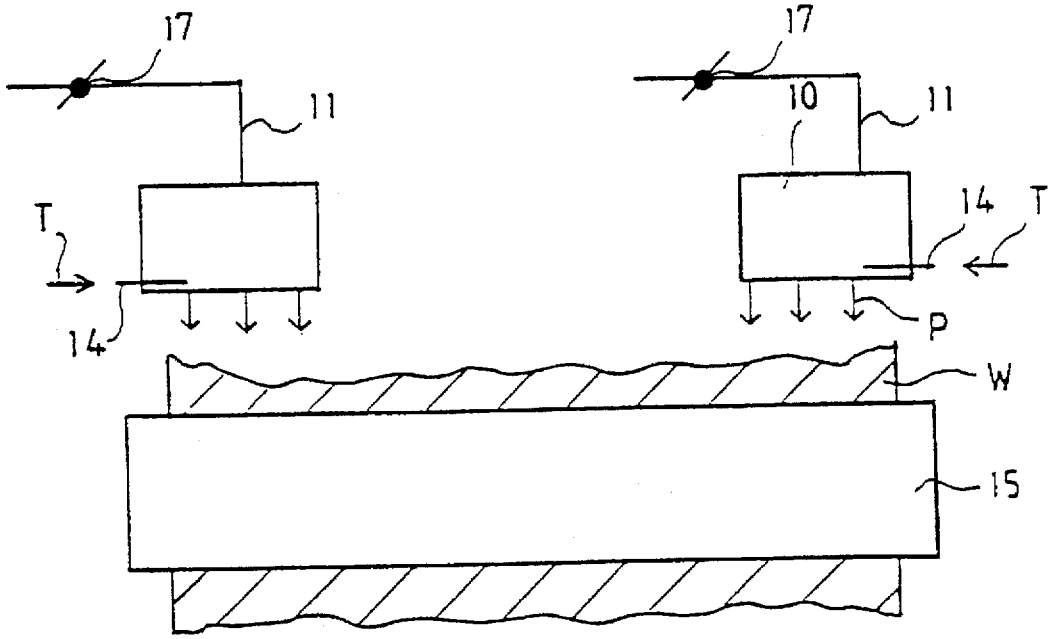
FIG. 5 is a second exemplifying embodiment of the invention seen in the direction of width of the web as an embodiment in which the blow width is narrower.
Figure 6:
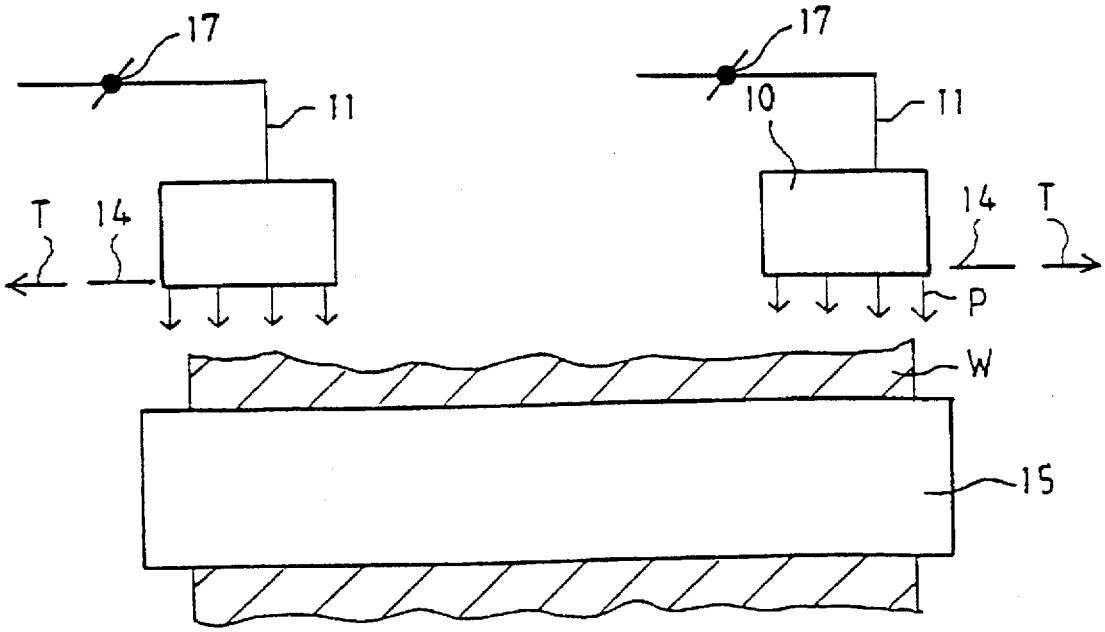
FIG. 6 is an illustration of the second embodiment of the invention shown in FIG. 5 wherein the blowing is carried out across the entire width of the web.

FIGS. 5 and 6 show a second exemplifying embodiment of the device 10, in which one device 10 in accordance with the invention is employed at each edge or lateral area of the web in the direction of width of the paper web W. By means of the devices, a unified blow area P is formed through the slot nozzle across the width of the device 10. The width of the device 10 is from about 100 mm to about 1000 mm, preferably from about 300 mm to about 600 mm. As is the case in the exemplifying embodiment shown in FIGS. 3 and 4, by means of the lateral boards 14, one of which is arranged in conjunction with each device 10 at the edge of the web, it is possible to regulate the width of the blowing applied to the lateral areas of the paper web W. In the embodiment shown in FIG. 5, the blowing applied to the lateral area is closed by means of the lateral board 14, and as shown in FIG. 6 the lateral boards 14 have been shifted so that the blowings P also extend to the lateral areas of the web. The direction of transfer of the lateral boards 14 is indicated by the arrows T. Into each device 10, the blow air is passed along the air intake duct 11, the flow in the duct being regulated and controlled by means of the control members 17. By means of the lateral boards 14, the blowing is closed in the lateral areas of the web W over a width of from about 0 mm to about 500 mm, preferably from about 0 mm to about 150 mm. In the exemplifying embodiment shown in FIGS. 5 and 6, blowing is not applied to the middle area of the web W.

The examples provided above are not meant to be exclusive. Many other variations of the present invention would be obvious to those skilled in the art, and are contemplated to be within the scope of the appended claims.

We claim:

1. A method for stabilizing a paper web in its run in a paper machine over a paper guide roll, comprising the steps of:

guiding the web over and in direct contact with the paper guide roll, separating the web from the paper guide roll at a separation point, guiding the web from the separation point in a straight run at least partially adjacent to a straight run of a drying wire, an opening nip of the paper guide roll being defined between the straight run of the web from the separation point and the paper guide roll, pressing the web against the drying wire by decreasing the negative pressure in the opening nip until a positive pressure prevails in the opening nip, said step of pressing the web comprising the step of directing air blowings into the opening nip along a face of the paper guide roll in a direction opposite to the direction of rotation thereof to enhance adherence of the web to the drying wire and create a momentary layer of air between the web and the paper guide roll, and producing a field of negative pressure through the straight run of the drying wire to cause the straight run of the web adjacent to the straight run of the drying wire to adhere to a lower face of the drying wire.

2. The method of claim 1, further comprising the step of directing the air blowings in a blow area uniformly across substantially the entire width of the web.

3. The method of claim 1, further comprising the step of directing the air blowings in a blow area extending from each lateral edge of the web along the width of the web whereby the blow areas do not unite.

4. The method of claim 2, further comprising the step of closing a portion of the blow area situated at each lateral edge of the web.

5. The method of claim 3, further comprising the step of closing a portion of the blow area situated at each lateral edge of the web.

6. The method of claim 1, wherein the step of producing a field of negative pressure comprises the step of operating a suction-blow box arranged in a loop of the drying wire along the straight run of the drying wire.

7. A combination of a paper guide roll and a device for stabilizing the running of a paper web in a paper machine in connection with the paper guide roll, the web being guided over and in direct contact with the paper guide roll, separated from the paper guide roll at a separation point and then guided from the separation point in a straight run at least partially adjacent to a straight run of a drying wire, an opening nip of the paper guide roll being defined between the straight run of the web from the separation point and the paper guide roll, comprising means defining an air chamber, a blow-air intake duct coupled to said air chamber, blow means for directing air blowings from said air chamber into the opening nip to press the web during its straight run against the drying wire during its straight run, said blow means comprising a nozzle beam having a nozzle opening extending toward the opening nip and communicating with said air chamber, and means for producing a field of negative pressure through the straight run of the drying wire to cause the straight run of the web adjacent to the straight run of the drying wire to adhere to a lower face of the drying wire.

8. The device of claim 7, wherein said nozzle opening is arranged such that the air blowings are directed along a face of the paper guide roll in a direction opposite to the direction of rotation thereof.

9. The device of claim 7, further comprising regulation means for regulating the blow width of said blow means.

10. The device of claim 9, wherein said regulation means comprise a movable lateral board arranged at each edge of said blow means.

11. The device of claim 9, further comprising two of said devices, one arranged at each lateral area of the web.

12. The device of claim 11, wherein said regulation means comprise a movable lateral board arranged in connection with each of said devices and at the edge of the web.

13. The device of claim 7, wherein the device is displaceably attached to a frame constructions of the paper guide roll such that during tail threading of the web, the device is shifted along with the paper guide roll to a tail threading position.

14. The device of claim 7, wherein the web is guided over the paper guide roll in direct contact with a surface of the paper guide roll.

15. A method for stabilizing a paper web in its run in a paper machine over a roll, comprising the steps of:

guiding the web over and in direct contact with the roll, separating the web from the roll at a separation point, guiding the web from the separation point in a straight run at least partially adjacent to a straight run of a press fabric, an opening nip of the roll being defined between the straight run of the web from the separation point and the roll, pressing the web against the press fabric by decreasing the negative pressure in the opening nip until a positive pressure prevails in the opening nip, and producing a field of negative pressure through the straight run of the drying wire to cause the straight run of the web adjacent to the straight run of the drying wire to adhere to a lower face of the drying wire.

16. The method of claim 15, wherein said step of pressing the web comprises the step of directing air blowings into the opening nip along a face of the roll in a direction opposite to the direction of rotation thereof to enhance adherence of the web to the press fabric and create a momentary layer of air between the web and the roll.

17. The method of claim 16, further comprising the steps of:

directing the air blowings in a blow area uniformly across substantially the entire width of the web, and closing a portion of the blow area situated at each lateral edge of the web.

18. The method of claim 16, further comprising the steps of:

directing the air blowings in a blow area extending from each lateral edge of the web along the width of the web whereby the blow areas do not unite, and closing a portion of the blow area situated at each lateral edge of the web.

19. An arrangement for stabilizing the running of a paper web in a paper machine between a press section and a dryer section, comprising a paper guide roll, the web being guided from the press section into contact with and over said paper guide roll, means for separating the web from said paper guide roll at a separation point and guiding the web from said separation point in a straight run, an opening nip of said paper guide roll being defined between the straight run of the web from said separation point and said paper guide roll, a drying wire for supporting the web in the dryer section, means for guiding said drying wire in a straight run at least partially adjacent to the straight run of the web, said drying wire guiding means comprising a reversing roll arranged above and in advance of said paper guide roll such that said reversing roll does not form a nip with said paper guide roll and a drying cylinder or equivalent cylinder in the dryer section, means defining an air chamber, blow means for directing air blowings from said air chamber into said opening nip to press the web during its straight run against said drying wire during its straight run, said blow means comprising a nozzle beam having a nozzle opening extending toward said opening nip and communicating with said air chamber, and means for producing a field of negative pressure through the straight run of the drying wire to cause the straight run of the web adjacent to the straight run of the drying wire to adhere to a lower face of the drying wire.

* * * * *